US005549378A

United States Patent [19]

Grabher

[11] Patent Number: 5,549,378

[45] Date of Patent: Aug. 27, 1996

[54] PANEL ADJUSTMENT COMPONENT FOR ADJUSTING THE INCLINE OF DRAWERS PULL-OUTS, OR OTHER SIMILAR ITEMS

[75] Inventor: Guenter Grabher, Fussach, Austria

[73] Assignee: Grass AG, Hochst/Vlbg., Austria

[21] Appl. No.: 324,110

[22] Filed: Oct. 14, 1994

[30] Foreign Application Priority Data

Oct. 16, 1993 [DE] Germany ..... 43 35 393.2

[51] Int. Cl.[6] ..... A47B 88/00

[52] U.S. Cl. ..... 312/348.4

[58] Field of Search ..... 312/348.4, 348.2, 312/348.1

[56] References Cited

U.S. PATENT DOCUMENTS 4,690,469 9/1987 Grass .

FOREIGN PATENT DOCUMENTS 3120840 9/1982 Germany .
3423732 1/1986 Germany .
0639252 11/1983 Switzerland .

*Primary Examiner*—Peter M. Cuomo
*Assistant Examiner*—Gerald A. Anderson
*Attorney, Agent, or Firm*—Petree Stockton, LLP

[57] ABSTRACT

A panel adjustment component for adjusting the incline a front panel of a drawer with railings and a front panel makes use of an angle member having a horizontal leg fastenable in a hollow railing of the drawer and a vertical leg to which the front panel is connected by a threaded bolt. An incline adjustment of the front panel is achieved by a threaded nut engaging the threaded bolt and disposed rotatable in an opening formed in the vertical leg.

11 Claims, 2 Drawing Sheets

1
2
3
4
5
6
7
8
9
10
11
12

PANEL ADJUSTMENT COMPONENT FOR ADJUSTING THE INCLINE OF DRAWERS PULL-OUTS, OR OTHER SIMILAR ITEMS

BACKGROUND AND FIELD OF THE INVENTION

The purpose of the invention is a panel adjustment component which adjusts the incline of the front panel of drawers, pull-outs and other similar items, especially the higher drawers; whereby, the front panel is fastened over an inset component with the rolling and slide rail, and, therefore, one of the adjustment devices located on the fastener angle can change its incline.

Adjustment devices of this type for drawer panels are already known from prior technology, as for example, the DE-OS 3 423 732 is a panel adjustment component to adjust the incline of the front panel with a slidable adjustment wedge. The front panel is pressed down from the drawer side slide with this wedge. One of the open notches along the railing allows the necessary shifting. The railing is, in that way, not fastened with the front panel, and the system is, therefore, rather unsuited for high panels. Furthermore, at least one screw must be lightly loosened before the incline adjustment and tightened again afterwards.

The incline adjustment, according to DE-OS 3 120 840 also operates in a similar manner. In order to adjust the incline of the front panel, one screw must also be loosened to permit a shifting possibility between the panel and the rolling.

The Swiss Patent Document 639 252 already shows an adjustment by means of a collar screw which is fed into a slot and whose threaded shank swings the assembly rail of a panel. An assembly rail is necessary between the panel and slide rail. Moreover, a panel adjustment while utilizing the railings, is, therefore, not possible, that is, only possible with play in the above mentioned execution form.

The Austrian Patent application 17 A 371/81 already shows the possibility of the incline adjustment of a high panel while retaining the required stability. Hereby, by means of a lengthwise adjustment of the railing, the incline of the front panel is adjusted by a certain measure deviating from the vertical. The form-fitting interlocking connection between the panel and railing, as well as between the panel and sliding rail, stays thereby in each given angle position.

SUMMARY OF THE INVENTION

The invention is based on a panel adjustment component, which especially concern high drawers with railings and, thereby, high front panels, allows incline adjustment with a simple method that does not require the use of tools; whereby, the front panel is connected over the angle with the railings which contribute to improved stability.

The problem is thereby solved with the invention in that the angle is produced out of steel or zinc and its horizontal side is fastened stationary and fixed on the preferably high railing profile, and the vertical side has an adjustment device in its upper area which connects form-firing, interlocking, and adjustable the vertical side with the front panel by means of a threaded bolt.

The resulting advantages are the following:

Because the incline adjustment is undertaken by a knurled nut, it can always be operated by anyone without tools. A precise incline adjustment of the front panel is, therefore, quickly achieved because the adjustment process and adjustment inspection are directly available successively alternating.

Those adjustment devices which require screws to be loosened in the adjustment process always follow the following procedure: loosen screws, shift the front panel, tighten screws, inspect and check the adjustment, loosen screws, shift the front panel, etc. It is easy to see that such an adjustment procedure, compared to the adjustment process described in the submitted device, is not very practical.

An additional advantage is that because of the flexible, resilient fastening of the front panel to the slide rail, as well as, there is an incline adjustment which results in a flexible, but yet, stationary connection of the front panel and the drawer slide.

Furthermore, the construction of the adjustment device is very simple in that is consists basically of a knurled nut which is connected with the front panel by a threaded bolt, so that an incline adjustment of the same is possible. By using the railing profile, the connection between the railing and the angle are, moreover, either pressed in or spot-welded. These methods are very simple and easy, but also produce stability.

The basis of the submitted invention results from not only the contents and subject matter of the individual patent claims, but also from any combination of the individual patent claims. All records, documents and evidence, inclusive of the summary, open and disclosed statements and declarations and indications and features, especially those represented embodiments in the drawings, will be claimed as fundamental and significant to the invention, as far as the claims individually or in combinations are relative to the position that the technology is new.

The innovation at hand will be explained more precisely by the various embodiments shown by the representational drawings. Hereby, additional significant features and advantages of the innovation will be concluded from the designs and their descriptions.

Indicated:

FIG. 1 a side view of the panel adjustment device in a drawer;

FIG. 2 a side view of the adjustment device.

FIG. 3 a front view of the angle piece fastened in the hollowing railing of the drawer;

FIG. 4 a side view of the front panel with the inset component, angle piece, and partial hollow railing and slide rail of the drawer.

DESCRIPTION OF THE PREFERRED EMBODIMENT

Figures 1, 2, 3:
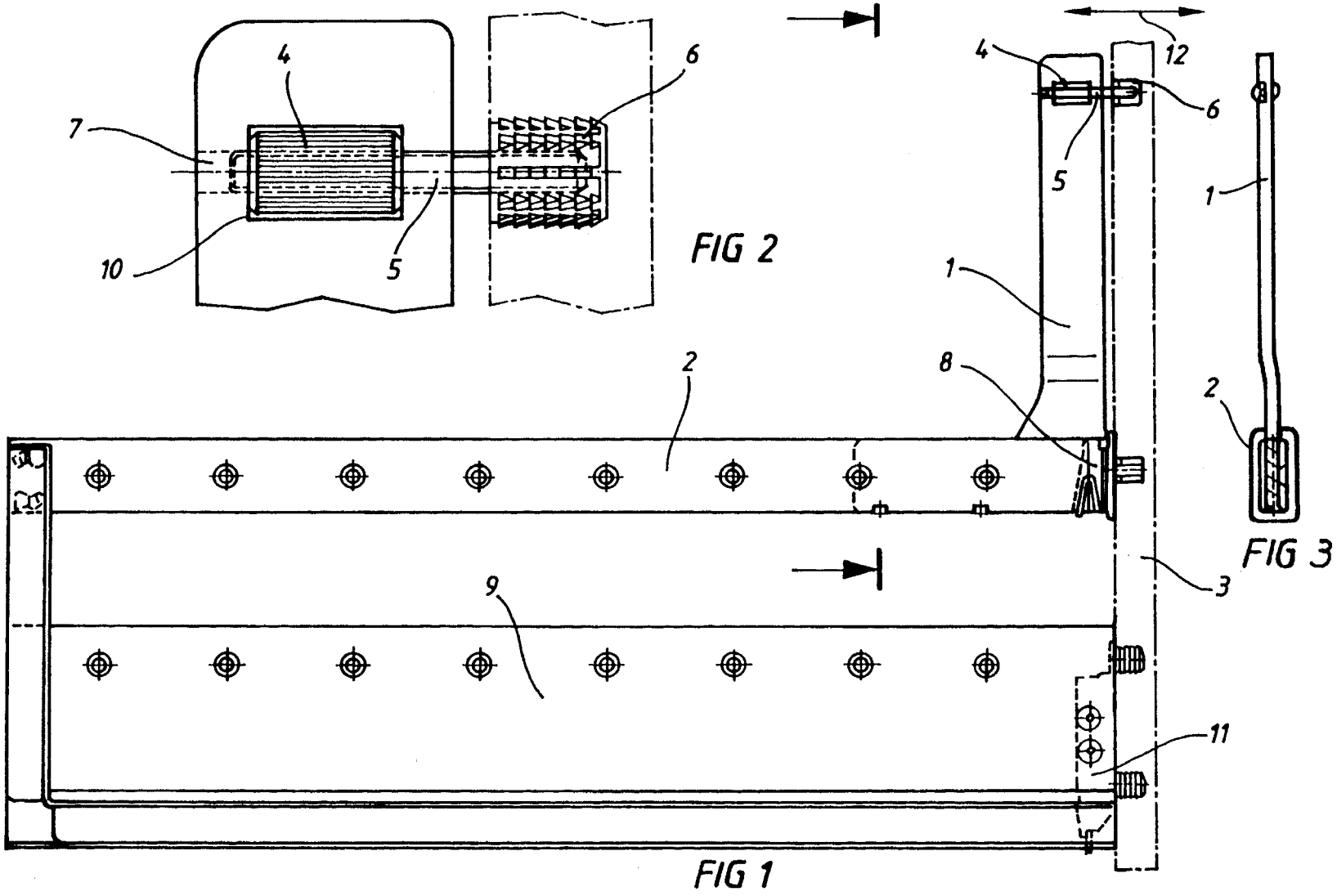
Figure 4:
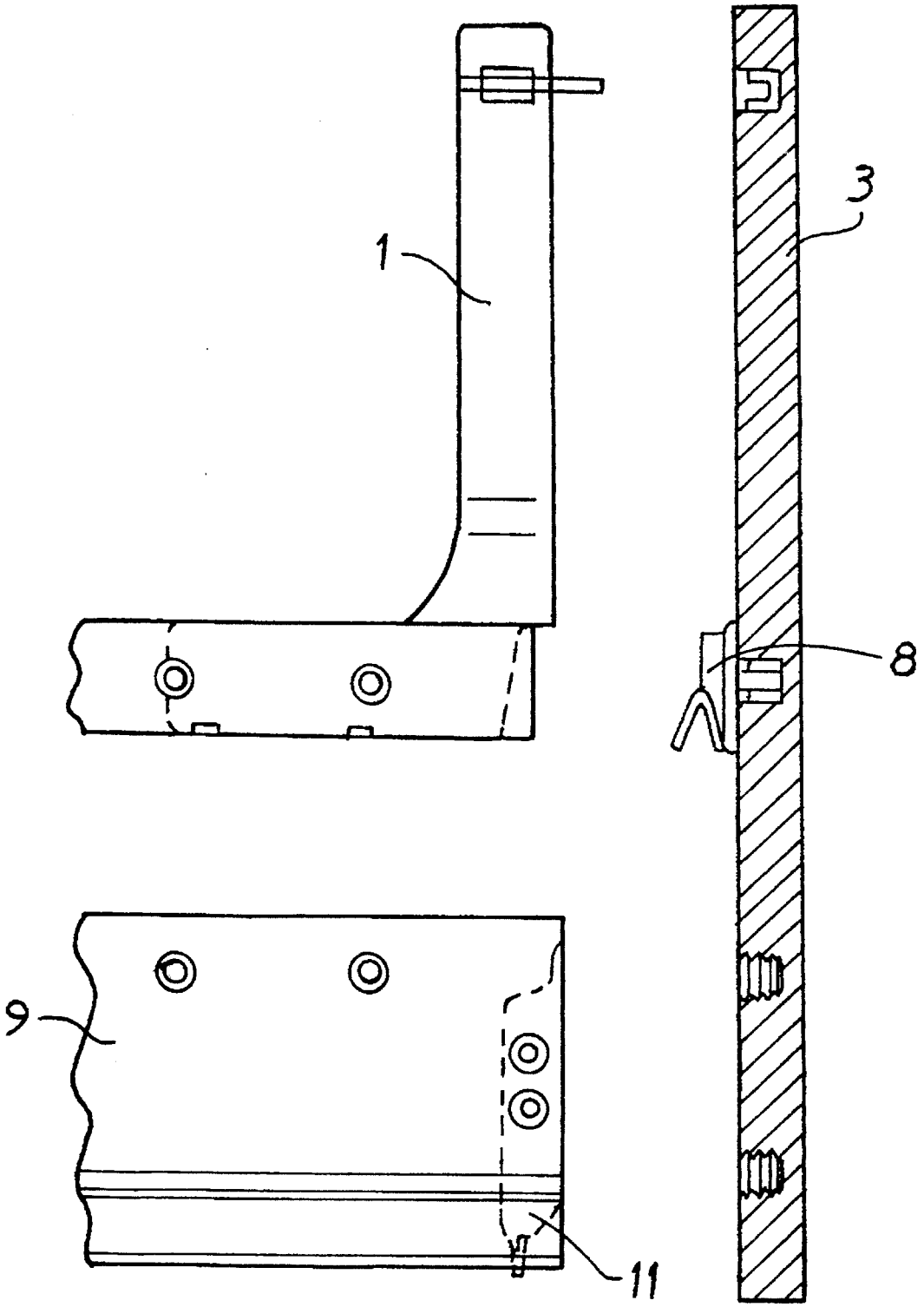

The design, construction and operation of the invention shall now be more closely described according to FIGS. 1 and 2.

A railing (2) is provided which has a hollow profile and, on its front end, has an angle (1) which is fastened stationary and fixed, in which the angle (1) is inserted and pressed in or spot-welded with its horizontal side in the railing. On the upper end of the vertical side, the angle (1) has a notch (10) which takes in a knurled nut (4) which operates over a threaded bolt (5) on the upper part of the front panel (3).

In the front area of the railing tube (2), a clearance is provided despite a pressed-in angle piece (1). The front panel (3) is inserted, catching into this clearance by means of an inset component (8), so that a fixed connection between the front panel (3) and the railing (2) is formed. The front panel (3) on its lower side is attached to the slide rail (9) by means of a panel fastener (11). The nut of the threaded bolt (5) turns itself through the knurled nut (4) on the upper end of the angle (1), and changes the distance of the panel (3) to the angle (1) in the arrow direction (12) approximately 3 mm.

Then a slight bending of the panel fastener (11) with the slide rail (9) follows, as well as a slight shifting of the inset component (8) in the railing (2). The adjustment movement is minimal in the area of the slide rail and the railing. This corrective movement increases to the upper side of the front panel according to the height of the front panel. The total operating incline adjustment is sufficient, however, to compensate for imprecisions in production.

FIG. 2 again shows the presented adjustment device; whereby, a side view is submitted. This presents the notch (10) in which the knurled nut (4) with the ability to turn is located, and by means of a threaded bolt (5) is fastened over a horizontal through hole (7) with the front panel (3). The threaded bolt (5) is hereby screwed into one of the pressed-in dowels in the panel (3).

This simple design and construction makes for an easy, functional and operational adjustment of the front panel's incline.

What is claimed is:

1. A panel adjustment component for adjusting the incline of a front panel of a drawer of a type having a slide rail and a hollow railing, the panel adjustment component comprising:

a front panel fastenable to said slide rail of said drawer by a panel fastener, the front panel also having an inset component slideably receivable in said hollow railing of said drawer;

an angle member made of a metal material and having a horizontal leg and a vertical leg, the horizontal leg being fastenable in said hollow railing of said drawer and the vertical leg having an upper area with an opening formed in the upper area of the vertical leg;

a threaded bolt connecting the front panel to the vertical leg with the front panel disposed proximate the upper area of the vertical leg; and a knurled nut disposed rotatable in said opening of the vertical leg and engaging said threaded bolt for adjusting the position of the front panel relative to the upper area of the vertical leg by rotating said knurled nut on said threaded bolt.

2. The panel adjustment component according to claim 1, wherein said metal material is steel.

3. The panel adjustment component according to claim 1, wherein said metal material is zinc.

4. The panel adjustment component according to claim 1, wherein said horizontal leg of said angle member is weldable in said hollow railing of said drawer.

5. The panel adjustment component according to claim 4, wherein said horizontal leg of said angle member is spot weldable in said hollow railing of said drawer.

6. The panel adjustment component according to claim 4, wherein said horizontal leg of said angle member is pressure weldable in said hollow railing of said drawer.

7. The panel adjustment component according to claim 1, further comprising a horizontally disposed through hole formed in said upper area of said vertical leg, and wherein said threaded bolt is engaged through said through hole.

8. The panel adjustment component according to claim 7, further comprising a dowel pressed in an opening formed in said front panel, said threaded bolt being threadably fastened in said dowel.

9. The panel adjustment component according to claim 1, said threaded bolt connecting said front panel to said vertical leg with the front panel spaced a predetermined distance from said upper area of the vertical leg.

10. The panel adjustment component according to claim 9, wherein said front panel is adjustable between positions adjacent said upper area of the vertical leg and up to about 6 millimeters from said upper area of the vertical leg.

11. In a panel adjustment component for adjusting the incline of a front panel of a drawer, said drawer having a slide rail, a hollow railing, and a front panel fastened to said slide rail by a panel fastener and said front panel having an inset component slideably received in said hollow railing of said drawer, the improvement wherein said panel adjustment component comprises an angle member made of metal and having a horizontal leg and a vertical leg, the horizontal leg being fastened in said hollow railing and the vertical leg having an upper area with an opening formed in the upper area of the vertical leg, a threaded bolt connecting the front panel to the vertical leg with the front panel disposed proximate the upper area of the vertical leg, and a knurled nut disposed rotatable in said opening and engaging said threaded bolt for adjusting the position of the front panel relative to the upper area of the vertical leg by rotating said knurled nut on said threaded bolt.

* * * * *